US012631185B1

(12) United States Patent
Keener

(10) Patent No.: US 12,631,185 B1
(45) Date of Patent: May 19, 2026

(54) SUBMERSIBLE PUMP WITH EXTERNAL SLICER

(71) Applicant: Gregg Keener, Ashland, OH (US)

(72) Inventor: Robert Keener, Ashland, OH (US)

(73) Assignee: Gregg Keener, Ashland, OH (US)

( * ) Notice: Subject to any disclaimer, the term of this patent is extended or adjusted under 35 U.S.C. 154(b) by 0 days.

(21) Appl. No.: 19/233,303

(22) Filed: Jun. 10, 2025

Related U.S. Application Data

(60) Provisional application No. 63/661,198, filed on Jun. 18, 2024.

(51) Int. Cl.
*F04D 7/04* (2006.01)
*F04D 13/08* (2006.01)

(52) U.S. Cl.
CPC ..... *F04D 7/045* (2013.01); *F04D 13/08* (2013.01)

(58) Field of Classification Search
CPC ..... F04D 7/045; F04D 13/08; F04D 29/2216; F04D 29/242
See application file for complete search history.

(56) References Cited

U.S. PATENT DOCUMENTS

| | | | | |
|---|---|---|---|---|
| 4,143,993 | A * | 3/1979 | Blum | F04D 29/2288 241/46.06 |
| 4,904,159 | A * | 2/1990 | Wickoren | F04D 7/045 415/121.1 |
| 5,044,566 | A * | 9/1991 | Mitsch | F04D 7/045 241/46.06 |
| 10,738,792 | B2 * | 8/2020 | Christ | F04D 29/242 |
| 11,333,161 | B2 * | 5/2022 | Zhang | F04D 29/242 |
| 11,525,454 | B2 * | 12/2022 | Liu | F04D 29/30 |
| 12,331,758 | B1 * | 6/2025 | Pohler | B02C 18/0092 |
| 2025/0122883 | A1 * | 4/2025 | Muck | F04D 29/4273 |

FOREIGN PATENT DOCUMENTS

| | | | | |
|---|---|---|---|---|
| WO | WO-2018095157 | A1 * | 5/2018 | F04D 29/24 |
| WO | WO-2019155487 | A1 * | 8/2019 | F04D 29/2216 |

* cited by examiner

*Primary Examiner* — Sang K Kim
(74) *Attorney, Agent, or Firm* — Ralph E. Jocke; WALKER & JOCKE

(57) ABSTRACT

A submersible pump (10) suitable for pumping liquid that includes suspended solids such as sewage, includes a housing (12) with a motor (34) and a pump chamber (66). The motor rotates an impeller (72) within the pump chamber and a slicer (92) that operates to slice solids before they enter the pump chamber into smaller pieces. The impeller vanes (130) have a vane height (H) that is at least 30% of the impeller diameter (D). The impeller has a continuous annular donut shape open area (144) that maintains solids suspended and flowing with the liquid into and out of the pump chamber.

28 Claims, 8 Drawing Sheets

SUBMERSIBLE PUMP WITH EXTERNAL SLICER

TECHNICAL FIELD

Exemplary arrangements relate to pumps suitable for pumping liquid material. Exemplary arrangements specifically relate to submersible pumps that are suitable for pumping sewage or other liquid material including suspended solids therein. Exemplary arrangements include an external slicing mechanism for reducing the size of solids before they enter the interior of the pump and an impeller that facilitates passage of solids from the pump interior.

BACKGROUND

The movement of liquid material is important in many types of processes. The movement of liquid often requires one or more pumps that cause the liquid to move between locations. The reliability of pumps to move liquids is critical to assuring that problems and damage to systems are avoided.

The pumping of a liquid becomes more challenging when the liquid includes suspended solids therein. Suspended solids that are of a large size, hard and/or are comprised of stringy or resilient material may cause clogging, binding or damage resulting in pump failure. The pumping of sewage is particularly challenging due to the various types of solid materials that are suspended in the waste flow.

Liquid pumps may benefit from improvements.

SUMMARY

Exemplary arrangements relate to a submersible pump that may be used to pump liquid materials that include various types of suspended solids. Some exemplary arrangements are particularly useful in pumping sewage.

An exemplary arrangement relates to a pump having a housing that is in operative connection with a motor. The motor is operative to rotate a drive shaft. The housing includes a pump chamber that includes an inlet opening that enables liquid to enter the pump chamber and an outlet opening that enables liquid to leave the pump chamber. An impeller is rotatably movably mounted in the pump chamber and is in operative connection with the drive shaft.

A slicer plate extends in axially disposed outward underlying relation of the inlet opening. The exemplary slicer plate includes a generally planar slicer face that is in a facing direction away from the inlet opening. The slicer plate includes at least one slicer plate fluid opening. The exemplary slicer plate further includes an axially extending drive opening.

A slicer extends in outwardly underlying relation of the slicer plate. The exemplary slicer includes a hub that is in operative connection with the drive shaft through the drive opening of the slicer plate. The slicer includes a plurality of radially outward extending blade edges. The exemplary blade edges are positioned immediately adjacent to the slicer plate. Rotation of the slicer causes solid materials that extend in the slicer plate fluid openings to be cut by the blade edges and reduced in size.

The exemplary impeller includes a circular plate portion. The circular plate portion has a circumferential periphery. An impeller diameter corresponds to the diameter of the circumferential periphery through the axis of rotation of the impeller. The exemplary impeller includes a central axial hub that extends downward from the plate portion and is bounded radially outward by a cylindrical hub outer surface.

The exemplary impeller includes a plurality of uniformly angularly spaced impeller vanes. Each of the impeller vanes is in fixed connection with the plate portion. Each impeller vane extends radially outward and in the operative position of the pump, vertically downward from the plate portion. Each exemplary impeller vane is bounded radially inwardly by a leading surface which extends in the vertical direction.

Each exemplary impeller vane includes a respective bottom edge. In the operative position of the pump, each bottom edge extends horizontally and radially outward. The exemplary leading surface of each vane is continuously disposed radially away from the hub outer surface between the plate portion and the bottom edge, and is positioned further radially away from the hub outer surface with increased proximity to the bottom edge. In exemplary arrangements the impeller blades extend downward away from the plate portion a distance that is at least 30% of the impeller diameter.

The exemplary impeller includes an impeller open area that comprises an axially centered radially extending annular continuous open area that is bounded vertically by the plate portion and radially outward by the respective leading surfaces of each of the impeller blades.

In operation of the pump rotation of the drive shaft responsive to the motor causes rotation of the impeller and the slicer. Rotation of the impeller is operative to cause liquid flow from outside and below the housing through the at least one slicer plate fluid opening and into the pump chamber through the inlet opening. Impeller rotation further causes the liquid to flow through the outlet opening of the pump. Rotation of the slicer is operative to slice solid material that is suspended in the liquid and that extends in the at least one fluid opening in the slicer plate.

In the exemplary arrangement the sliced material that is suspended in the liquid that passes through the inlet opening of the pump chamber enters the impeller open area. The suspended material remains suspended away from the impeller vanes in the impeller open area until the liquid in which the material is suspended moves to the outlet of the pump chamber due to impeller vane rotation. The exemplary impeller arrangement avoids engagement of the suspended material with the leading surfaces of the impeller and avoids the accumulation of the material in the pump chamber. Exemplary arrangements also produce higher pump head and flow which facilitate the movement of the suspended solids through the pump chamber.

Further features of exemplary arrangements are described in the following Detailed Description and the appended drawings.

DETAILED DESCRIPTION

Figure 1:
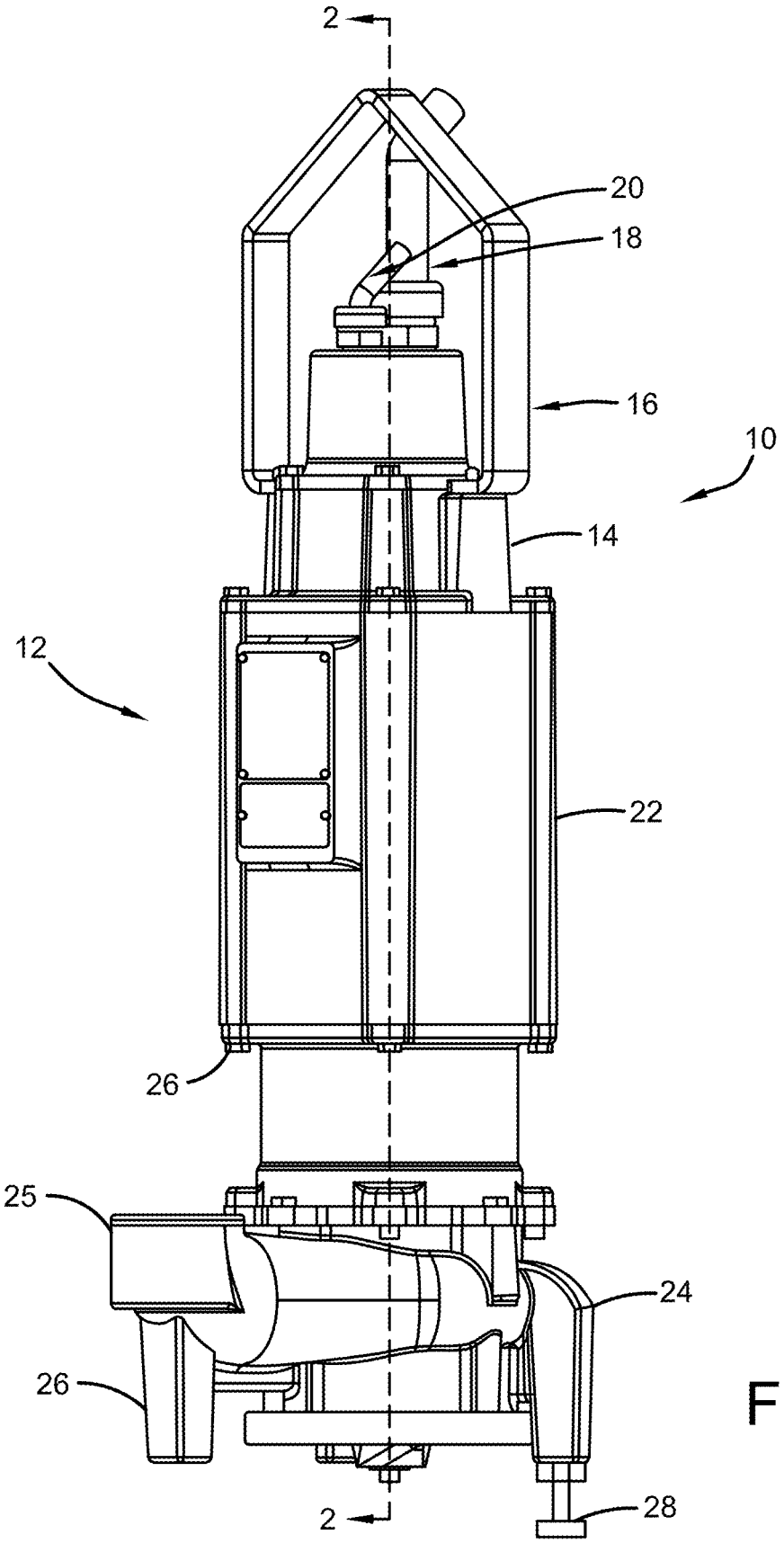
FIG. 1 is a side view of an exemplary submersible pump.

Referring now to the drawings and particularly to FIG. 1, there is shown therein an exemplary pump 10. The exemplary pump includes a housing 12. The exemplary housing 12 includes an upper housing portion 14. The upper housing portion 14 includes a handle 16. The handle 16 facilitates the engagement of the pump for installation and removal. The exemplary upper housing portion is also in connection with an electrical power line 18. An electrical line 20 is also connected to the upper housing portion 14. In exemplary arrangements the electrical line 20 may be used to provide signals. Such signals may include electrical signals from a level switch or other control device which is operative to control pump operation. Electrical line 20 may also be used to provide signals indicative of pump status, signals from sensors in the pump housing, or other information.

Housing 12 further includes a mid housing portion 22. The housing further includes a lower housing portion 24. The lower housing portion includes a pump outlet 25. The exemplary housing portions are held together by releasable fasteners 26 to facilitate disassembly and repair of the pump. The lower housing portion 24 includes three downward extending support projections 26. Each support projection includes a downward facing threaded opening that is configured to receive a leg 28, only one of which is shown. In exemplary arrangements the legs are adjustable such as by including a threaded rod that is engaged in the threaded opening in the respective support projections so as to be able to selectively position the bottom of the pump including the inlet thereto, in a selected position above a floor or other structure in a sump or tank in which the pump is positioned. Of course it should be understood that this configuration while useful, is exemplary and other support approaches may be used.

Figure 2:
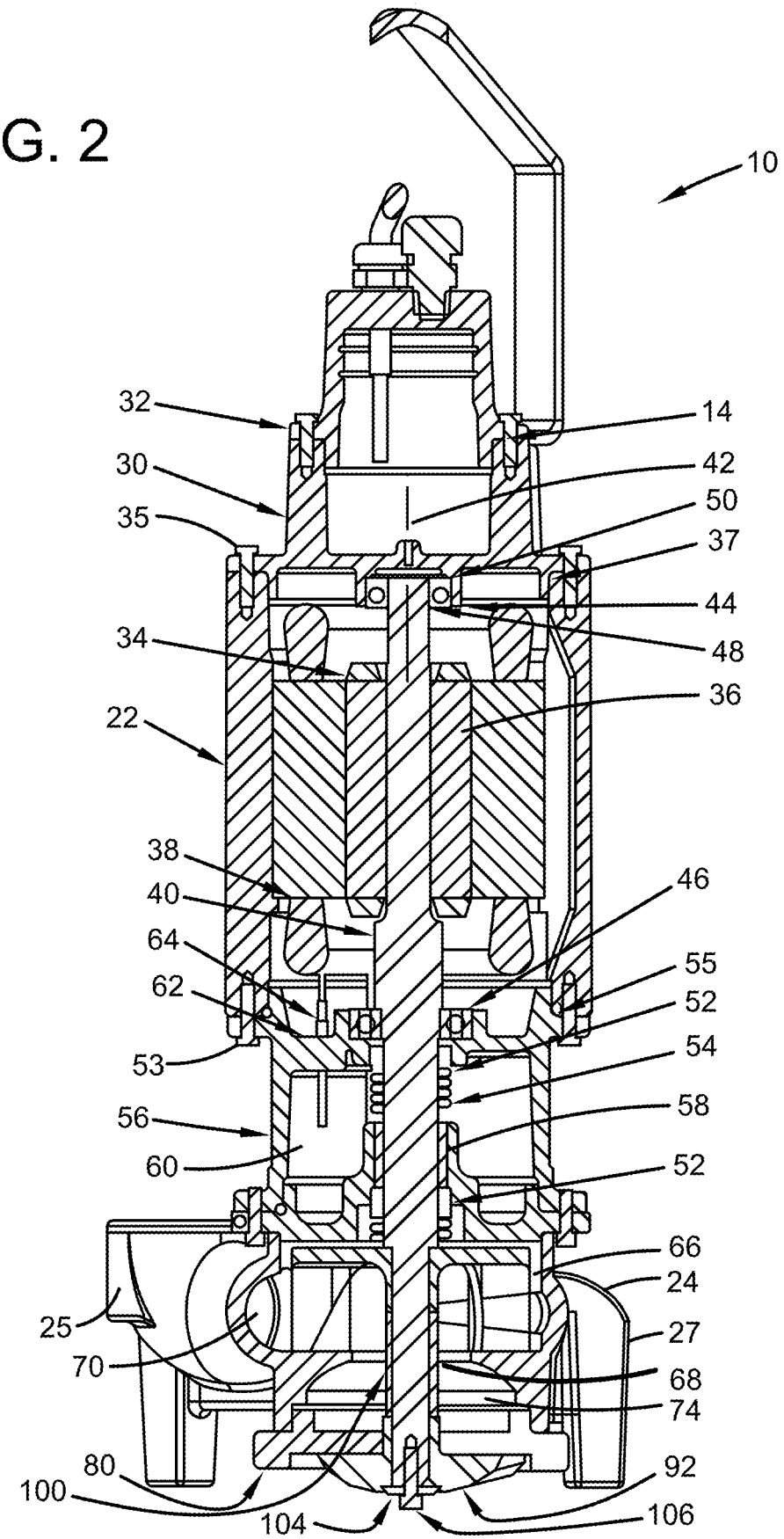
FIG. 2 is a cross-sectional view of the pump taken along line 2-2 in FIG. 1.

As shown in greater detail in FIG. 2, the exemplary upper housing portion 14 is comprised of a two-piece cap 30 which pieces are held together by releasable fasteners 32. The exemplary cap is configured to house electrical components including wiring, relays, circuitry, sensors and the like.

The exemplary mid housing portion 22 serves as a housing for a motor generally indicated 34. The exemplary mid housing portion is in sealed connection with the upper housing portion through fasteners 35 and a seal 37. The exemplary motor 34 comprises an electric motor that includes a rotor 36 and a stator 38. The stator 38 is in fixed connection with the housing. The rotor 36 is rotatable within the housing and is in fixed operative connection with a rotatable drive shaft 40. In the operative position of the pump the drive shaft 40 extends along a vertically extending axis 42.

The exemplary drive shaft 40 is rotatably journaled in an upper bearing 44 and in a lower bearing 46. The exemplary drive shaft is held in a fixed axial position by a suitable snap ring 48 or other retainer. The mid housing portion 22 that houses the rotor and the stator of the motor 34 is further sealed against infiltration of moisture by suitable seals 50 and 52. The exemplary seals 52 are held in the proper axial positions relative to the drive shaft by suitable retainers 54.

The exemplary mid housing portion 22 includes a lower bearing retainer 56. The lower bearing retainer is in releasable connection with the remainder of the mid body portion through fasteners 53 and is sealed relative to the area of the mid housing portion that includes the rotor and the stator by a suitable seal 55. The lower bearing retainer 56 includes a bushing 58 that is in relative rotatable engagement with the drive shaft 40. The exemplary lower bearing retainer bounds a cavity 60 into which a moisture probe 62 extends. The exemplary moisture probe is connected to a wiring harness 64 which is usable to provide signals indicative that the moisture probe detects that the seals have suffered a failure and water has been able to infiltrate into the cavity 60 in the lower bearing retainer 56. Of course it should be understood that this arrangement is exemplary and in other arrangements a moisture sensor may not be used. Alternatively in other arrangements other or additional sensors such as temperature sensors, vibration sensors or other types of sensors suitable for sensing conditions of the pump may be included.

The drive shaft 40 extends in the lower housing portion 24. The lower housing portion includes a pump chamber 66 that extends therein. The exemplary pump chamber 66 includes a circular inlet opening 68 which is shown in greater detail in FIG. 9. The pump chamber 70 further includes an outlet opening 70 that in the operative position of the pump is vertically higher than the inlet opening. The outlet opening 70 is fluidly connected to the pump outlet 25. An impeller 72 is rotatably movable in the pump chamber 66 and is in fixed operative connection with the drive shaft 40. The exemplary drive shaft extends axially downward from the pump chamber and through the inlet opening 68.

The exemplary lower housing portion 22 includes a fluid passage 74 therein that is disposed in axially centered relation and below the inlet opening 68. The exemplary fluid passage 74 is bounded by a radially extending annular ledge 76. A vertically extending annular wall 75 extends downward from the annular ledge 76. The vertically extending annular wall 75 terminates at a downward facing radially outward extending annular face 78.

Figure 3:
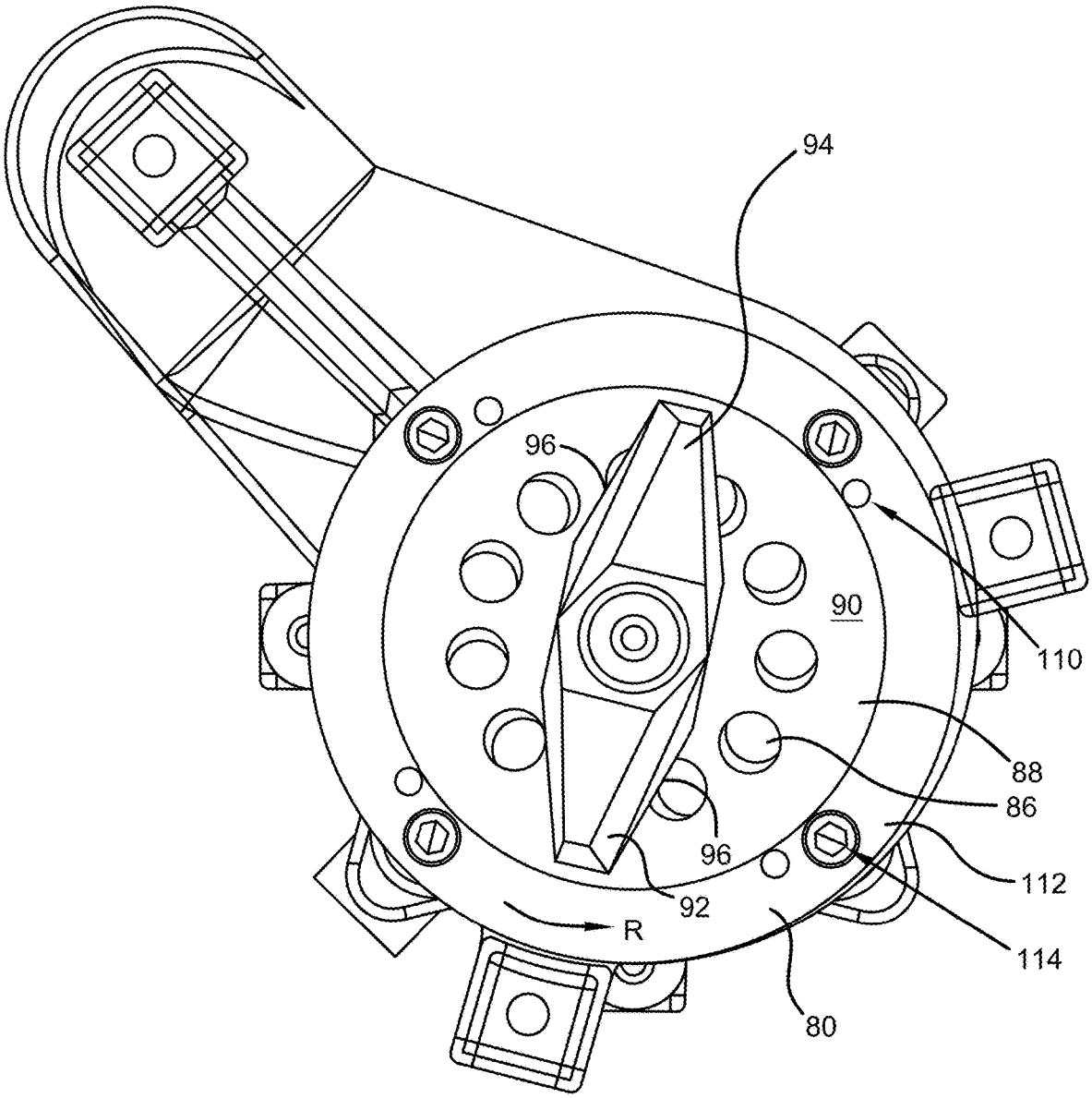
FIG. 3 is a bottom view of the exemplary pump.
Figure 5:
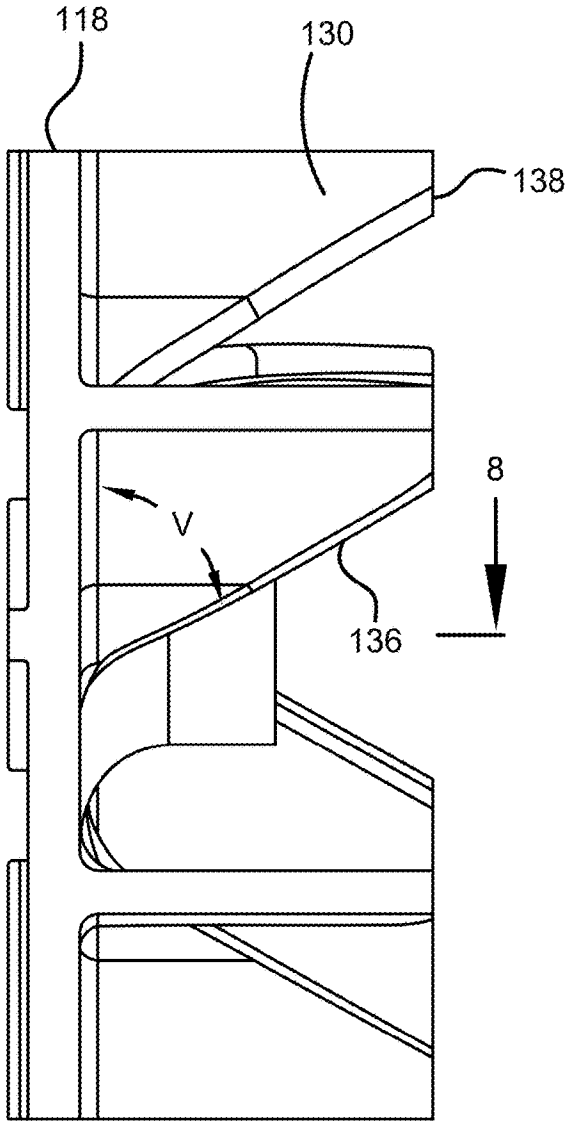
FIG. 5 is a side view of the exemplary impeller.

A slicer plate 80 extends below the fluid passage 74 and the inlet opening 68. The exemplary slicer plate 80 includes an annular upward extending projection 82 that extends in close fitting slidable engagement with the vertical annular wall 75. The exemplary slicer plate further includes an axially centrally located slicer drive opening 84. The drive shaft 40 extends through the slicer drive opening 84. The slicer plate further includes at least one, and in the exemplary arrangement, a plurality of slicer plate fluid openings 86. The slicer plate fluid openings are in fluid communication with the fluid passage 74 and the inlet opening 68. The plurality of slicer plate fluid openings 86 which are shown in greater detail in FIG. 3, are fluidly in advance of the inlet opening 68 of the pump chamber and serve as the inlet to the pump 10. Of course it should be understood that this arrangement while useful, is exemplary and in other arrangements other pump inlet configurations may be used.

Figure 9:
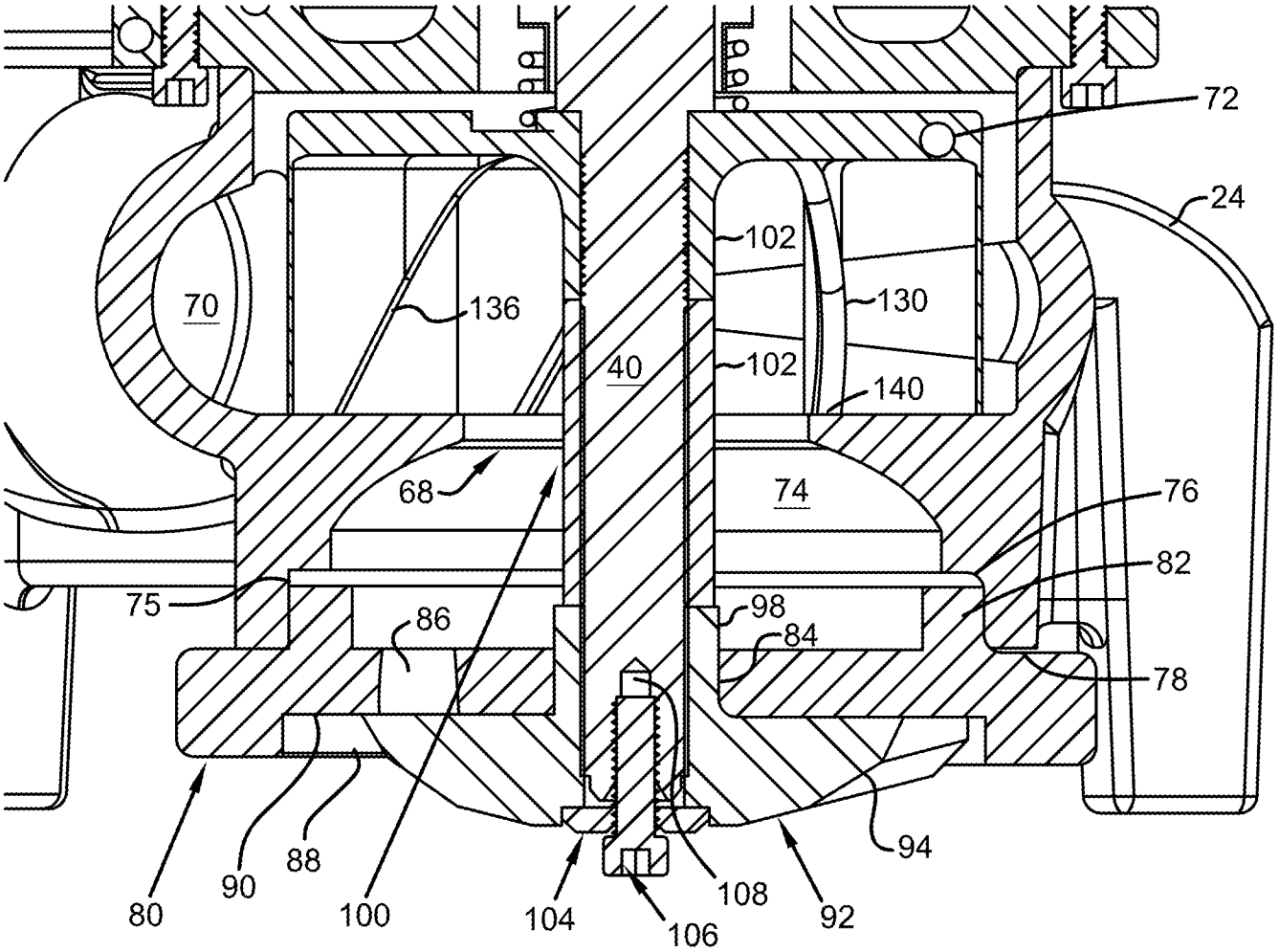
FIG. 9 is an enlarged view of the lower housing of the pump.

The downward facing surface of exemplary slicer plate 80 includes an upward extending circular recess 88. The circular recess is bounded upwardly by a planar slicer face 90. The slicer plate fluid openings extend in the slicer face 90 as shown in FIG. 9. A slicer 92 extends in outward underlying relation of the slicer plate 80. The exemplary slicer includes a pair of opposed radially outward extending arms 94. Each of the arms include a linearly straight blade edge 96. Each blade edge extends in immediately adjacent underlying relation of the slicer face 90.

The exemplary slicer further includes a slicer hub 98. The slicer hub 98 includes an opening that is configured to receive the end of drive shaft 40 therein. The slicer hub 98 terminates upwardly in engagement with a cylindrical spacer 100. The exemplary spacer 100 extends between cylindrical hub 102 of the impeller 72 and the slicer hub 98. The exemplary spacer 100 has the same outer surface diameter as the hub 102 and serves as a downward extension and as part of the hub. The slicer 92 further includes a central recess that is configured to engage a retaining washer 104. A retaining screw 106 extends through the washer 104 and is engaged in a threaded opening 108 in the lower end of drive shaft 40. The retaining screw 106 serves to hold the slicer 92 in fixed operative engagement with the drive shaft 40 such that the slicer rotates with the drive shaft. Of course it should be understood that this configuration of the slicer and its engagement with the drive shaft and the motor while useful, is exemplary and in other arrangements other approaches may be used.

The exemplary slicer and slicer plate arrangement of the exemplary arrangement utilizes the principles described in U.S. Pat. No. 12,173,728 issued Dec. 24, 2024 and U.S. patent application Ser. No. 18/413,422 filed Jan. 16, 2024, the disclosures of each of which are incorporated herein by reference in their entirety.

The exemplary slicer 92 and slicer plate 80 of the exemplary arrangement utilize the principles and approaches for adjustment and securing of the slicer plate 80 relative to the lower housing portion 24 and the slicer 92 that are described in detail in the incorporated U.S. patent application Ser. No. 18/413,422. As shown in FIG. 3 the exemplary slicer plate 80 has threaded adjusting screws 110 that extend in threaded openings (not separately shown). The threaded adjusting screws are configured to extend parallel to the axis 42 through the annular portion 112 of the slicer plate which is radially disposed outwardly from the circular recess 88. The adjusting screws are configured to abuttingly engage the annular face 78 of the lower housing portion.

Retaining fasteners 114 extend parallel to the axis 42 and upward through unthreaded openings (not separately shown) in the annular portion of the slicer plate 112. The retaining fasteners 114 are threaded and engage correspondingly threaded openings in the annular face 78. As a result the exemplary arrangement enables the vertical and angular adjustment of the slicer plate 80 and the slicer face 90 thereof relative to the pump lower housing portion and the blade edges 96 of the slicer 92. This is done in a manner like that described in the incorporated disclosure and enables the blade edges 96 of the slicer to be positioned in aligned parallel relation with the planar slicer face 90 and disposed a set distance away therefrom such that suitable cutting action by the blade edges is provided as the blade edges pass over the slicer plate fluid openings 86.

In the exemplary arrangement the slicer 92 rotates in the direction of Arrow R as shown in FIG. 3. As the exemplary slicer rotates each blade edge 96 moves entirely across the area of each of the slicer plate fluid openings 86 at the slicer face 90. Each blade edge 96 is operative to slice suspended solids currently extending in a respective fluid opening, as the blade edge moves in overlying relation of respective slicer opening toward a peripheral edge of the respective slicer plate fluid opening which is in facing relation with the direction of rotation of the slicer. The exemplary configuration of the slicer and the slicer plate fluid openings provides that only one slicer blade edge at any time during rotation of the slicer is in a cutting condition. The cutting condition corresponds to a portion of the rotational movement in which a blade edge of the slicer may encounter a high level of resistance to rotation due to the presence of solid materials that are being sliced between the blade edge and the edge of the fluid opening in the slicer plate that is in facing relation of the direction of rotation. By having only one blade edge in a cutting condition at any time during slicer rotation, the amount of power that the motor must supply to successfully accomplish the slicing function is reduced compared to the power that would be required if a plurality of blade edges were simultaneously in the cutting condition.

The cutting condition to which only one slicer blade edge is limited at any one time during slicer rotation may be configured based on the nature of the solids that are expected to be encountered by the slicer, the size, number and geometry of the slicer plate fluid openings, the size of the slicer blade and the available power from the motor which is utilized in the pump. In some exemplary arrangements the components in the pump may be configured such that the cutting condition may correspond to a blade edge being rotationally between a position in which the blade edge extends diametrically across a respective slicer plate fluid opening and the blade edge reaching the facing peripheral edge of the fluid opening. Such an arrangement may be used in situations where relatively large solids are expected to be encountered such that a blade edge may encounter solids and high resistance to rotation beginning when the blade extends diametrically across the respective slicer plate fluid opening.

In other exemplary arrangements the components of the pump may be configured so that the cutting condition corresponds to a blade edge being rotationally between a position in which the blade edge has passed in underlying relation over more than half of the area of the respective slicer plate fluid opening (75% to 85% for example), and a position in which the blade edge reaches the peripheral edge of the fluid opening. Such an arrangement may be utilized where the nature of the solids required to be sliced will not be encountered or will not substantially resist rotational movement until the blade edge has reached a condition where it is passed more than 50% of the area of the fluid opening.

Of course in other exemplary arrangements other numbers and configurations of the slicer blade edges and the slicer plate fluid openings may be used so that during slicer rotation only one blade edge at a time is in a cutting condition in which, based on the nature of the solids and geometry of the fluid openings, the slicer will encounter high resistance to rotation due to slicing solids that are present. As can be appreciated if the size and character of the solids encountered by the pump may be relatively large and resistant to being severed, an arrangement in which the cutting condition is configured to commence when the cutting blade has passed a smaller percentage of the area of the fluid opening may be utilized to reduce resistance to slicer rotation. Of course the approach of having only one slicer blade in a cutting condition at any time during slicer rotation while useful, is exemplary and in other arrangements other approaches may be used.

The configuration of the exemplary impeller 72 is useful in moving solids suspended in the liquid that have been sliced through operation of the slicer in the slicer plate. The exemplary impeller is shown in greater detail in FIGS. 4 through 10. The exemplary impeller 72 includes a plate portion 116. The plate portion 116 is circular in configuration. The plate portion 116 is bounded radially outward by an outer periphery 118 which extends circumferentially about the plate portion. The impeller diameter corresponds to a diameter D through the axis 42 across the circular outer periphery 118.

Figure 4:
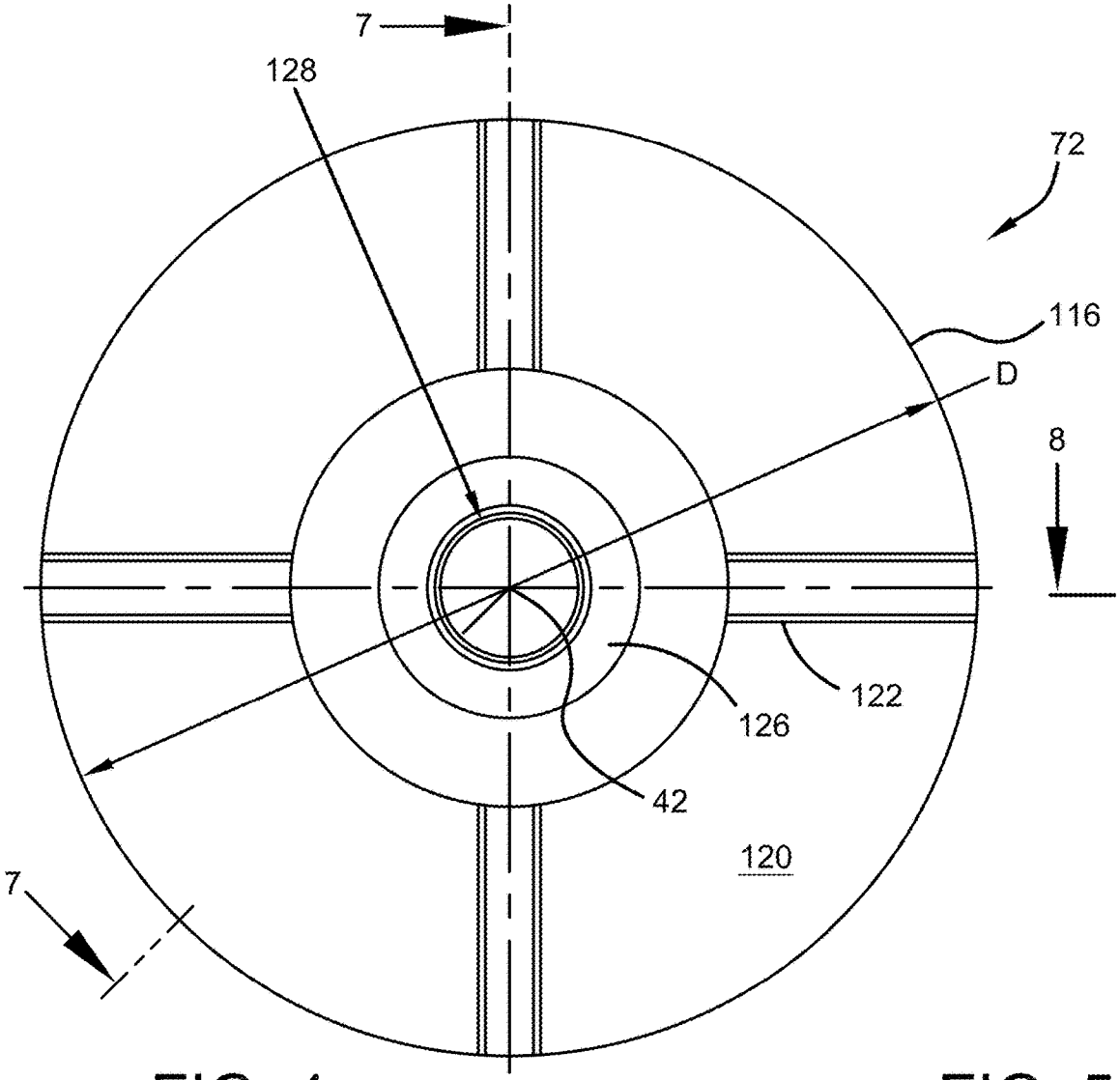
FIG. 4 is a top view of an exemplary impeller of the pump.
Figure 6:
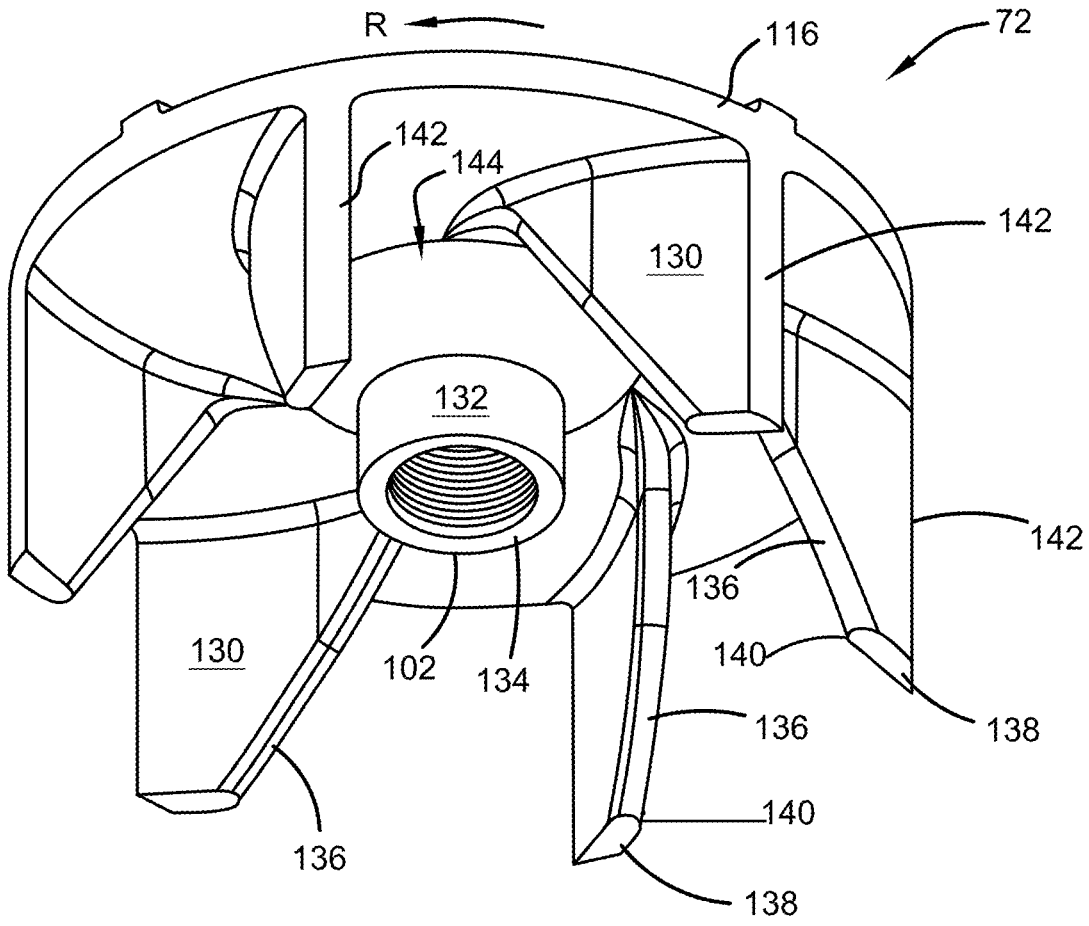
FIG. 6 is a perspective view of the exemplary impeller.
Figure 7:
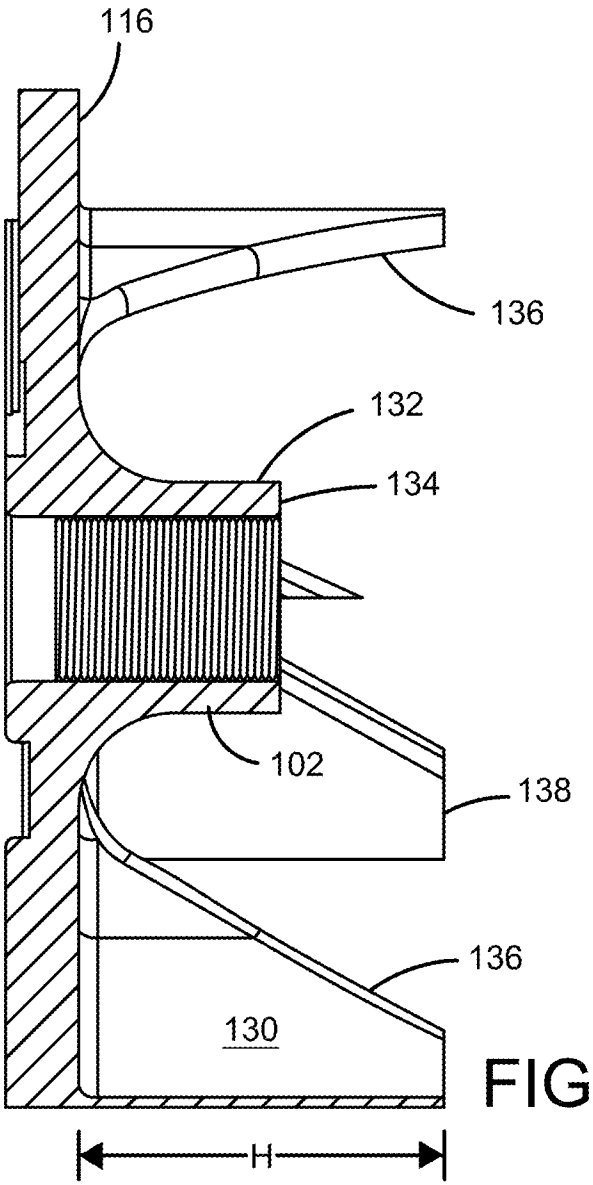
FIG. 7 is a cross-sectional view of the impeller along line 7-7 in FIG. 4.
Figure 8:
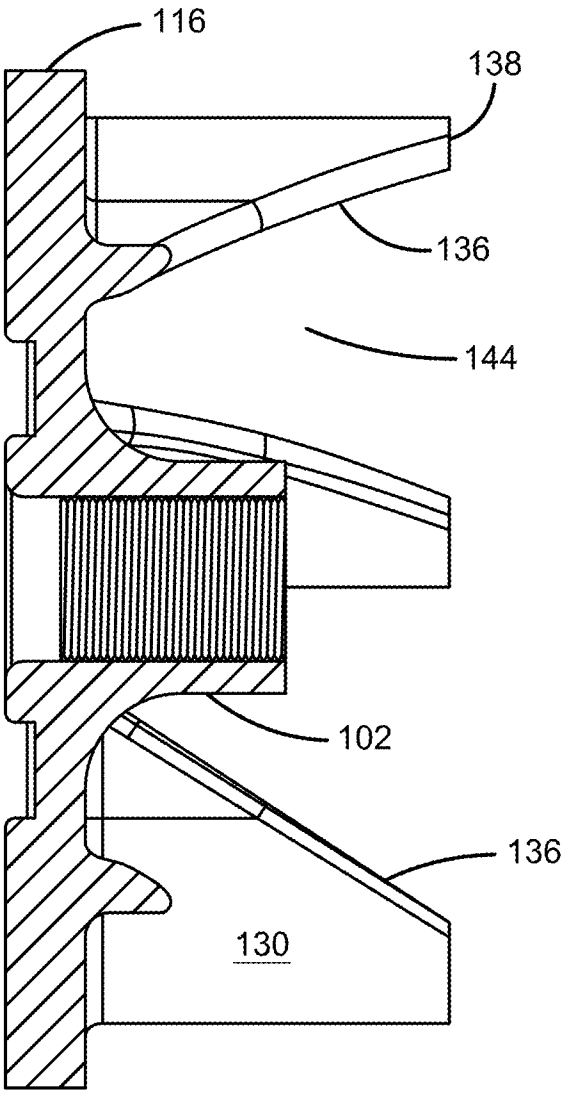
FIG. 8 is a cross-sectional view of the impeller along line 8-8 in FIG. 4.

As shown in FIG. 4 the upper surface 120 of the plate portion 116 includes a plurality of radially extending strengthening ribs 122. The strengthening ribs 122 extend from a central raised disc portion 124. In the exemplary arrangement the raised disc portion 124 has a lesser vertical height above the upper surface 120 than the strengthening ribs 122. Of course it should be understood that this approach while useful, is exemplary and in other arrangements other approaches to provide strengthening structures may be used.

The exemplary impeller includes a raised central cylindrical boss 126. The cylindrical boss extends vertically above the disc portion 124 and in surrounding relation of the central opening 128 through which the drive shaft 40 extends when the impeller is in the operative position. In the exemplary arrangement the cylindrical boss is at least the same height above the upper surface 120 as the strengthening ribs 122 and provides additional strength to the impeller where it is in engagement with the shaft.

A plurality of impeller vanes 130 extend on a lower side of the impeller 72. The impeller vanes are in fixed operatively attached connection with the plate portion. The exemplary impeller vanes are equally angularly spaced about the axis and extend radially outward and downward from the plate portion 116 in the operative position of the pump.

As previously mentioned, also extending from the lower side of the impeller 72 is a cylindrical hub 102 that extends in surrounding relation of the drive shaft 40. The cylindrical hub is bounded radially outward by a cylindrical hub outer surface 132. In the exemplary arrangement the cylindrical hub 102 has an annular downward facing surface 134. As shown in FIG. 9 for example, the downward facing surface 134 of the impeller hub 102 is in abutting relation with the spacer 100 which in the exemplary arrangement has an outer diameter that is the same as the hub outer surface 132. In the exemplary arrangement the spacer 100 fluidly serves as part of the cylindrical hub and downwardly extends to a level that is vertically below the impeller vanes 130.

Each of the exemplary impeller vanes 130 includes a radially outward and downward extending leading surface 136. In the exemplary arrangement each leading surface extends downward away from the plate portion in a location that is disposed radially away from the hub outer surface 132. In some exemplary arrangements the minimum radial distance a leading edge is disposed away from the hub outer surface is ½ inch. However in many exemplary arrangements the minimum distance that each leading edge is disposed away from the hub outer surface (which includes the outer surface of the sleeve 100) is greater than ½ inch.

In the exemplary arrangement shown each leading surface 136 extends radially and vertically downward away from the plate portion at a vane angle V. In exemplary arrangements the vane angle is between 45° and 90°. However it has been found that a useful vane angle V is generally 60° which for purposes hereof means 60°+/−10°. The exemplary leading surface in the radially inward direction is continuously a curved smooth surface. This configuration reduces the risk of solids catching and accumulating on the leading surface. Further in the operative position of the pump the leading surface extends further downward with further radial distance away from the axis. This facilitates the solid material that may engage the leading surface sliding over, downward and away from the leading surface with liquid flow.

The exemplary impeller vanes 130 extend downwardly to a bottom edge 138. Each bottom edge in the exemplary arrangement extends radially and horizontally. In exemplary arrangements the bottom edge of each vane extends linearly in a horizontal direction. The respective leading surface 136 of the respective impeller vane meets the respective bottom edge 138 at a respective engagement location 140. The exemplary impeller vanes extend radially outward from the engagement location at a constant vertical height and terminate at a respective outer vane edge 142. In the operative position each exemplary outer vane edge extends vertically and corresponds to the outer periphery 118 of the plate portion 116.

In the exemplary arrangement each of the impeller vanes 130 have a vane height (H) at the outer vane edge that corresponds to the vertical distance from the plate portion to the bottom edge 138. In exemplary arrangements the vane height is at least 30% of the impeller diameter. In some exemplary arrangements the van height is at least 37% of the impeller diameter. Further in some exemplary arrangements the bottom edge extends a radial distance horizontally that is at least 10% of the impeller diameter. In some exemplary arrangements the bottom edge extends horizontally a distance that is between 10% and 20% of the impeller diameter.

In the exemplary arrangement the impeller vanes 130 have a curved configuration as shown. The exemplary impeller vanes are curved away from the rotational direction R in which the impeller rotates during operation. However it should be understood that in other arrangements linearly straight radially extending impeller vanes or other vane shapes may be used.

The configuration of the exemplary impeller 72 provides a radially extending annularly continuous impeller open area 144 that is centrally located in the impeller. This continuous open annular area in the impeller may be referred to herein as donut shaped. The radially extending annularly continuous open area extends horizontally between the hub outer surface 132 (which for purposes of this disclosure also includes the portion of the outer surface of the spacer 100 that is horizontally aligned with the impeller blades) and the leading surfaces 136 of the impeller vanes, and vertically between the plate portion and the bottom edges 138 of the impeller vanes. In some exemplary arrangements the horizontal radial dimension of the open area 144 between the hub outer surface and the leading surfaces of the impeller vanes to the engagement locations with the bottom edges, is in a range of 5% to 30% of the impeller diameter. Particularly useful results have been found when the horizontal radial dimension of the impeller open area between the hub outer surface and the leading surfaces of the impeller vanes to the engagement locations with the bottom edges, is in a range of 9% to 27% of the impeller diameter. Useful results are also obtained with different vane angles and leading surface configurations but with a horizontal radial dimension of the impeller open area between the hub outer surface and each engagement location of a respective impeller leading surface and a bottom edge of between 20% to 30% of the impeller diameter.

Figure 10:
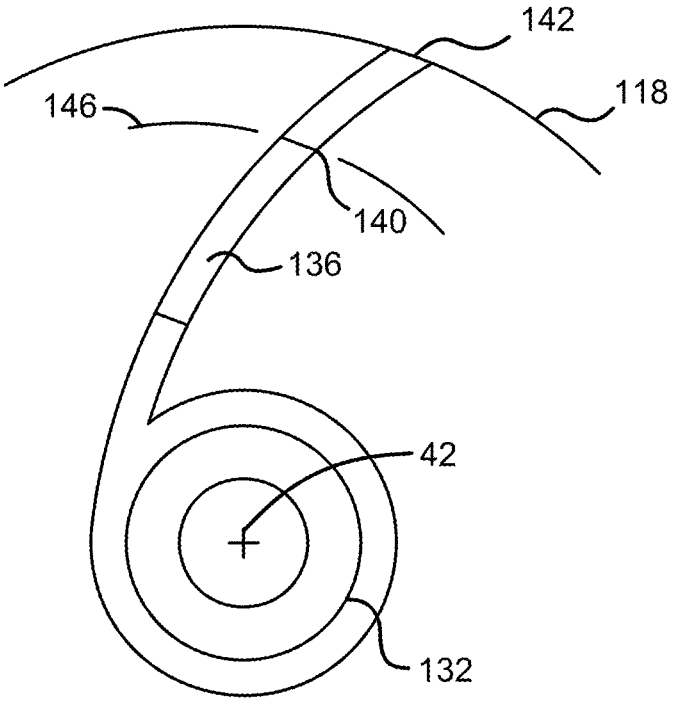
FIG. 10 is a partial bottom view of the impeller showing a bottom view of an exemplary impeller vane.

As can be appreciated, in the exemplary configuration of the impeller vanes 130 the engagement locations 140 at which the respective leading surfaces 136 meet the respective bottom edges 138 of the impeller vanes extend in an engagement circle 146, a segment of which is shown in FIG. 10. As shown in FIG. 9 in the exemplary arrangement the diameter of the circular inlet opening 68 to the pump chamber is generally the same as the diameter of the engagement circle 146 in which the engagement locations 140 of the impeller vanes 130 extend. As used herein to describe this relationship, generally the same means that the diameter of the engagement circle and the diameter of the inlet opening are the same +/−10%.

In operation of the exemplary arrangement the motor 34 is operative to cause rotation of the drive shaft 40 about the axis 42. Rotation of the drive shaft causes rotation of the impeller 72 and rotation of the slicer 92. Rotation of the impeller causes liquid and suspended solids to flow from below the slicer plate outside the housing, and upward through the at least one slicer plate fluid opening 86. Rotation of the slicer 92 is operative to slice solid material that extends in the at least one slicer plate fluid opening.

Liquid and sliced suspended solids flow upwardly through the inlet chamber 74 and into the inlet opening 68 to the pump chamber 66. The liquid and suspended solids in the pump chamber are accelerated by the impeller vanes and moved through centrifugal action in the pump chamber outward through the outlet opening 70 and the pump outlet 25.

In the exemplary arrangement the vane height of the impeller vanes is operative to generate relatively higher head and a much greater flow rate than some conventional impellers of a comparable diameter. Further the exemplary donut shaped impeller open area that extends between the hub outer surface and the leading surfaces of the vanes provides an area where the sliced material remains temporarily suspended until it is pulled by the liquid flow radially outward between the vanes and leaves the pump chamber through the outlet opening. The exemplary configuration of the impeller vanes causes the solids to remain suspended in the liquid and to not attach to the leading surfaces or other surfaces of the impeller or the pump chamber. The feature of the exemplary arrangement that the engagement circle has generally the same diameter as the inlet opening helps to keep solids suspended and away from the vanes in the open area. In addition the increased flow that results from the vane height and exemplary impeller vane configurations helps to move the suspended material within the liquid flow which further reduces the risk that the chopped up material will collect and accumulate in the pump chamber. This provides for greater durability and more reliable pump operation.

Thus the exemplary arrangements achieve improved operation, eliminate difficulties encountered in the use of prior devices and systems, and attain the useful results that are described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples, and the new and useful features and relationships are not limited to the exact features that have been shown and described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. A pump apparatus comprising:

a housing, a motor, wherein the motor is in operative connection with the housing, wherein the motor is in operative connection with a drive shaft, wherein the drive shaft extends along an axis, wherein in an operative position of the apparatus the axis extends vertically, a pump chamber, wherein the pump chamber extends within the housing, wherein the pump chamber includes an axially extending inlet opening configured to enable liquid to flow into the pump chamber, and an outlet opening vertically above the inlet opening and configured to enable liquid to flow out of the pump chamber, an impeller, wherein the impeller is rotatably positioned in the pump chamber, wherein the impeller is in operative connection with the drive shaft and is rotatable about the axis, a slicer plate, wherein in the operative position the slicer plate extends in axially disposed underlying relation of the inlet opening, wherein the slicer plate includes a slicer face, wherein the slicer face is in a downward facing direction away from the inlet opening, an axially aligned slicer drive opening, wherein the drive opening extends through the slicer plate, at least one slicer plate fluid opening, wherein the at least one slicer plate fluid opening extends vertically through the slicer plate at a location disposed radially away from the slicer drive opening, a slicer, wherein the slicer extends in outwardly underlying relation of the slicer face, is in operatively engaged rotational connection with the drive shaft, whereby the slicer is in operative connection with the drive shaft through the slicer drive opening, includes at least one blade edge, wherein the at least one blade edge extends radially outward away from the axis and is positioned in immediately adjacent relation to the slicer face, wherein the impeller includes a circular axially centered plate portion, wherein the plate portion has an outer periphery, wherein an impeller diameter corresponds to the outer periphery, an axially centered cylindrical hub, wherein the hub is operatively attached to the plate portion, is operatively engaged with the drive shaft, and is bounded radially outward by a hub outer surface, a plurality of uniformly angularly spaced impeller vanes in attached connection with the plate portion, wherein in the operative position each impeller vane extends downward from the plate portion to a radially and horizontally extending bottom edge, and radially outward from a leading surface to a vertically extending outer vane edge, wherein the outer vane edge radially corresponds to the outer periphery, wherein the leading surface is continuously radially disposed away from the hub outer surface between the plate portion and the bottom edge, wherein each impeller vane has a vane height parallel to the axis from the plate portion to the bottom edge that is at least 30% of the impeller diameter, wherein rotation of the drive shaft responsive to the motor is operative to cause rotation of the impeller and the slicer, whereby the impeller is operative to cause liquid flow from outside the housing through the at least one slicer plate fluid opening, through the inlet opening and the pump chamber, and outward through the outlet opening while the at least one blade edge of the slicer is operative to slice solid material that extends in the at least one fluid opening.

2. The apparatus according to claim 1 wherein the respective leading surface of each respective impeller vane extends further downward with further radial distance from the axis.

3. The apparatus according to claim 1
wherein the respective leading surface of each respective impeller vane
extends further downward with further radial distance from the axis, and
meets with the respective bottom surface of the impeller vane at a respective engagement location,
wherein the inlet opening is circular, is axially centered and has an inlet opening diameter,
wherein the engagement locations of the plurality of impeller vanes extend in an engagement circle, wherein the engagement circle has an engagement circle diameter that is generally the same as the inlet opening diameter.

4. The apparatus according to claim 1
wherein each impeller vane has a vane height parallel to the axis from the plate portion to the bottom edge that is at least 37% of the impeller diameter.

5. The apparatus according to claim 1
wherein the leading surface is disposed away from the hub outer surface continuously from the plate portion to the bottom surface at least a minimum radial distance of ½ inch.

6. The apparatus according to claim 1
wherein the leading surface of each impeller vane extends downward away from the plate portion at a vane angle between 45° and 90°.

7. The apparatus according to claim 1
wherein the leading surface of each impeller vane extends downward away from the plate portion at a vane angle of generally 60°.

8. The apparatus according to claim 1
wherein the impeller includes a radially extending annularly continuous impeller open area, wherein the impeller open area extends continuously
horizontally between the hub outer surface and the respective leading surface of each of the plurality of impeller vanes, and
vertically between the plate portion and the respective bottom edge of each of the plurality of impeller vanes.

9. The apparatus according to claim 1
wherein the impeller includes a radially extending annularly continuous impeller open area, wherein the impeller open area extends continuously
horizontally between the hub outer surface and the respective leading surface of each of the plurality of impeller vanes, and
vertically between the plate portion and the respective bottom edge of each of the plurality of impeller vanes,
wherein the impeller open area has a larger horizontal radial dimension between the hub outer surface and the respective leading surfaces of the impeller vanes with vertical proximity to the respective bottom edges of the respective impeller vanes.

10. The apparatus according to claim 1
wherein the impeller includes a radially extending annularly continuous impeller open area, wherein the impeller open area extends continuously
horizontally between the hub outer surface and the respective leading surface of each of the plurality of impeller vanes, and
vertically between the plate portion and the respective bottom edge of each of the plurality of impeller vanes,
wherein a horizontal radial dimension of the impeller open area between the hub outer surface and the respective leading surface of each of the plurality of impeller vanes is in a range of 5 percent to 30 percent of the impeller diameter.

11. The apparatus according to claim 1
wherein the impeller includes a radially extending annularly continuous impeller open area, wherein the impeller open area extends continuously
horizontally between the hub outer surface and the respective leading surface of each of the plurality of impeller vanes, and
vertically between the plate portion and the respective bottom edge of each of the plurality of impeller vanes,
wherein a horizontal radial dimension of the impeller open area between the hub outer surface and the respective leading surface of each of the plurality of impeller vanes is in the range of from 9 percent to 27 percent of the impeller diameter.

12. The apparatus according to claim 1
wherein the impeller includes a radially extending annularly continuous impeller open area, wherein the impeller open area extends continuously
horizontally between the hub outer surface and the respective leading surface of each of the plurality of impeller vanes, and
vertically between the plate portion and the respective bottom edge of each of the plurality of impeller vanes,
wherein a horizontal radial dimension of the impeller open area between the hub outer surface and each engagement location at which a respective leading surface meets a respective bottom edge of a respective impeller vane, is between 20% to 30% of the impeller diameter.

13. The apparatus according to claim 1
wherein the impeller includes a radially extending annularly continuous impeller open area, wherein the impeller open area extends continuously
horizontally between the hub outer surface and the respective leading surface of each of the plurality of impeller vanes, and
vertically between the plate portion and the respective bottom edge of each of the plurality of impeller vanes,
wherein the impeller open area has a larger horizontal radial dimension between the hub outer surface and the leading surface of each of the impeller vanes with vertical proximity to the respective bottom edges of the respective impeller vanes,
wherein the horizontal radial dimension varies from less than 10% of the impeller diameter at the plate portion to greater than 25% of the impeller diameter at engagement locations at which the leading surfaces meet the bottom edges.

14. The apparatus according to claim 1
wherein each of the bottom edges extend horizontally a distance that is at least 10% of the impeller diameter.

15. The apparatus according to claim 1
wherein each of the bottom edges extend horizontally a distance that is between 10% and 20% of the impeller diameter.

16. The apparatus according to claim 1
wherein the impeller rotates in a rotational direction,
wherein each of the impeller vanes are curved away from the rotational direction.

17. The apparatus according to claim 1
wherein each of bottom edges extend linearly straight horizontally, and
wherein each of the outer vane edges extend linearly straight vertically.

18. A pump apparatus comprising:
housing,
a motor, wherein the motor is in operative connection with the housing,
a drive shaft, wherein the motor is in operative connection with the drive shaft, wherein in the operative position of the apparatus the drive shaft extends along a vertical axis,
a pump chamber within the housing, wherein the pump chamber includes
an axially extending inlet opening configured to enable liquid flow into the pump chamber, and an outlet opening vertically above the inlet opening and configured to enable liquid to flow from the pump chamber,
an impeller, wherein the impeller is rotatably positioned in the pump chamber, wherein the impeller is in operative connection with the drive shaft and is rotatable about the axis,
a slicer plate, wherein the slicer plate
includes a plurality of slicer plate fluid openings, wherein the slicer plate fluid openings are in fluid connection with the inlet opening, and
wherein in the operative position the slicer plate extends below and fluidly in advance of the inlet opening,
a slicer, wherein the slicer
includes at least one blade edge,
wherein the at least one blade edge extends in downward immediately adjacent relation with the slicer plate fluid openings,
wherein the slicer is in operative connection with the drive shaft, wherein rotation of the drive shaft is operative to cause the at least one blade edge to move across the fluid openings,
wherein the impeller includes
a circular plate portion, wherein the plate portion has a circumferential periphery, wherein an impeller diameter corresponds to a distance through the axis across the circumferential periphery,
a plurality of uniformly angularly spaced impeller vanes, wherein each of the impeller vanes
is in fixed connection with the plate portion,
extends radially outward and vertically downward from the plate portion,
an impeller open area, wherein the impeller open area comprises an axially centered radially extending annularly continuous open area that is bounded vertically by the plate portion and radially outwardly by respective leading surfaces of the impeller vanes,
wherein each of the impeller vanes extend downward from the plate portion a distance that is at least 30% of the impeller diameter,
wherein rotation of the drive shaft responsive to the motor is operative to cause rotation of the impeller and movement of the slicer, whereby the impeller is operative to cause liquid flow from outside the housing through the at least one slicer plate fluid opening, through the inlet opening and the pump chamber, and outward through the outlet opening while the at least one blade edge of the slicer is operative to slice solid material that extends in the at least one fluid opening.

19. The apparatus according to claim 18
wherein the impeller includes an axially centered cylindrical hub,
wherein the hub
is in fixed connection with the plate portion,
is in fixed operative connection with the drive shaft,
extends downward from the plate portion,
is bounded radially outwardly by a cylindrical hub outer surface,
wherein the impeller open area extends radially outward from the hub outer surface.

20. The apparatus according to claim 19
wherein each of the impeller vanes terminate vertically downward at a horizontally extending bottom edge,
wherein the leading surface of each respective impeller vane extends from the plate portion to the bottom edge of the respective impeller vane,
wherein the impeller open area has a larger horizontal radial dimension between the hub outer surface and the respective leading surfaces of the impeller vanes with vertical proximity to the respective bottom edges of the impeller vanes.

21. The apparatus according to claim 20
wherein the inlet opening comprises an axially centered circular opening and has an inlet opening diameter,
wherein each leading surface of each respective impeller vane meets the respective bottom edge of the respective impeller vane at an engagement location,
wherein the engagement locations of the plurality of impeller vanes extend in an engagement circle, wherein the engagement circle has an engagement circle diameter,
wherein the engagement circle diameter is generally the same as the inlet opening diameter.

22. The apparatus according to claim 21
wherein a minimum horizontal radial dimension of the impeller open area between the hub outer surface and the respective leading surface of each of the plurality of impeller vanes is continuously at least ½ inch.

23. The apparatus according to claim 22
wherein the horizontal radial dimension of the impeller open area between the hub outer surface and the respective leading surface of each of the plurality of impeller vanes is in a range of 5% to 30% of the impeller diameter.

24. The apparatus according to claim 23
wherein a horizontal radial dimension of the impeller open area between the hub outer surface and each of the engagement locations of the impeller vanes is between 20% and 30% of the impeller diameter.

25. A pump apparatus comprising:
a housing,
a motor, wherein the motor is in operative connection with the housing,
wherein the motor is in operative connection with a drive shaft, wherein the drive shaft extends along an axis, wherein in an operative position of the apparatus the axis extends vertically,
a pump chamber, wherein the pump chamber extends within the housing,
wherein the pump chamber includes
an axially centered vertically extending inlet opening configured to enable liquid to flow into the pump chamber, and
an outlet opening vertically above the inlet opening and configured to enable liquid to flow out of the pump chamber, an impeller, wherein the impeller is rotatably positioned in the pump chamber, wherein the impeller is in operative connection with the drive shaft and is rotatable about the axis, a slicer plate, wherein in the operative position the slicer plate extends in axially disposed underlying relation of the inlet opening, wherein the slicer plate includes a slicer face, wherein the slicer face extends in a downward facing direction away from the inlet opening, an axially aligned slicer drive opening, wherein the drive opening extends through the slicer plate, at least one slicer plate fluid opening, wherein the at least one slicer plate fluid opening is fluidly in advance of the inlet opening, extends vertically through the slicer plate at a location disposed radially away from the slicer drive opening and is vertically in direct underlying relation below the inlet opening, a slicer, wherein the slicer extends in outwardly underlying relation of the slicer face, is in operatively engaged rotational connection with the drive shaft, whereby the slicer is in operative connection with the drive shaft through the slicer drive opening, includes at least one blade edge, wherein the at least one blade edge extends radially outward away from the axis and is positioned in immediately adjacent relation to the slicer face, wherein the impeller includes a circular axially centered plate portion, wherein the plate portion has an outer periphery, wherein an impeller diameter corresponds to the outer periphery, an axially centered cylindrical hub, wherein the hub is operatively attached to the plate portion, is operatively engaged with the drive shaft, and is bounded radially outward by a hub outer surface, a plurality of uniformly angularly spaced impeller vanes in attached connection with the plate portion, wherein in the operative position each impeller vane extends beginning radially outward away from the outer surface of the hub, downward from the plate portion to a radially and horizontally extending bottom edge, and radially outward from a radially innermost leading surface to a vertically extending outer vane edge, wherein the outer vane edge radially corresponds to the outer periphery, wherein the leading surface is continuously radially disposed away from the hub outer surface and is disposed radially further away from the hub outer surface with increasing proximity to the bottom edge, wherein in each of the leading surfaces bound a continuous annular open area, wherein the open area extends continuously radially between the hub outer surface and the leading surfaces, and immediately above the inlet opening, wherein each impeller vane has a vane height parallel to the axis from the plate portion to the bottom edge that is at least 30% of the impeller diameter, wherein rotation of the drive shaft responsive to the motor is operative to cause rotation of the impeller and the slicer, wherein the impeller is operative to cause liquid flow from outside the housing through the at least one slicer plate fluid opening, through the inlet opening and the pump chamber, and outward through the outlet opening while the at least one blade edge of the slicer is operative to slice solid material that extends in the at least one fluid opening, wherein solids are suspended within the liquid in the continuous annular open area until the liquid in which the solids are suspended flows radially outward between the vanes.

26. The apparatus according to claim 25 wherein the continuous annular open area extends parallel to the axis from the lower surface of the plate portion to the bottom edge of each of the impeller vanes.

27. The apparatus according to claim 25 wherein the inlet opening has an inlet opening diameter, wherein the continuous annular open area has an open area diameter at the bottom edges of the plurality of impeller vanes that is at least as large as the inlet opening diameter.

28. The apparatus according to claim 25 wherein each leading surface of each impeller vane in a radially inward direction comprises a continuously curved smooth surface, wherein solid material engaged with a respective leading surface is caused to slide downward along the respective leading surface during impeller rotation.

* * * * *